US010165388B1

(12) United States Patent
DiVerdi et al.

(10) Patent No.: US 10,165,388 B1
(45) Date of Patent: Dec. 25, 2018

(54) PARTICLE-BASED SPATIAL AUDIO VISUALIZATION

(71) Applicant: ADOBE SYSTEMS INCORPORATED, San Jose, CA (US)

(72) Inventors: Stephen Joseph DiVerdi, Oakland, CA (US); Yaniv De Ridder, San Francisco, CA (US)

(73) Assignee: Adobe Systems Incorporated, San Jose, CA (US)

( * ) Notice: Subject to any disclaimer, the term of this patent is extended or adjusted under 35 U.S.C. 154(b) by 0 days.

(21) Appl. No.: 15/814,254

(22) Filed: Nov. 15, 2017

(51) Int. Cl.
*H04S 7/00* (2006.01)

(52) U.S. Cl.
CPC ..... *H04S 7/40* (2013.01); *H04S 2400/15* (2013.01)

(58) Field of Classification Search
None
See application file for complete search history.

(56) References Cited

U.S. PATENT DOCUMENTS 8,560,303 B2 * 10/2013 Beack ..... H04S 7/40 704/200
9,779,093 B2 * 10/2017 Jarvinen ..... G06F 17/30026
2006/0149558 A1 * 7/2006 Kahn ..... G10L 15/063 704/278
2008/0255688 A1 * 10/2008 Castel ..... H04N 7/163 700/94
2009/0182564 A1 * 7/2009 Beack ..... H04S 3/008 704/500
2013/0022206 A1 * 1/2013 Thiergart ..... G10L 19/008 381/17
2015/0124167 A1 * 5/2015 Arrasvuori ..... H04R 3/005 348/485
2016/0134988 A1 * 5/2016 Gorzel ..... G10L 19/00 381/22

FOREIGN PATENT DOCUMENTS

WO WO 2017178309 A1 * 10/2017 ..... G06F 3/011

OTHER PUBLICATIONS

Nguyen, C., DiVerdi, S., Hertzmann, A., & Liu, F. (May 2017). Vremiere: In-Headset Virtual Reality Video Editing. In Proceedings of the 2017 CHI Conference on Human Factors in Computing Systems (pp. 5428-5438). ACM.
Nguyen, C., DiVerdi, S., Hertzmann, A., & Liu, F. (Oct. 2017). CollaVR: Collaborative In-Headset Review for VR Video. In Proceedings of the 30th Annual ACM Symposium on User Interface Software and Technology (pp. 267-277). ACM.

* cited by examiner

*Primary Examiner* — Peter Vincent Agustin
(74) *Attorney, Agent, or Firm* — Shook, Hardy & Bacon, L.L.P.

(57) ABSTRACT

Methods and systems are provided for visualizing spatial audio using determined properties for time segments of the spatial audio. Such properties include the position sound is coming from, intensity of the sound, focus of the sound, and color of the sound at a time segment of the spatial audio. These properties can be determined by analyzing the time segment of the spatial audio. Upon determining these properties, the properties are used in rendering a visualization of the sound with attributes based on the properties of the sound(s) at the time segment of the spatial audio.

20 Claims, 12 Drawing Sheets

PARTICLE-BASED SPATIAL AUDIO VISUALIZATION

BACKGROUND

Creators of immersive experiences often include audio as a component. To this end, to make the experience truly immersive, the audio should align with what is being depicted in any visual component. Incorrectly aligned audio and video can result in an unrealistic and disjointed environment. In a two-dimensional experience, stereo audio can provide sound using two channels, one channel for sounds occurring to the left and one channel for sounds occurring to the right relative to a location where, for example, a user is listening to the stereo audio. These two channels are capable of being played in each ear to indicate where in the experience sound is being generated. A three-dimensional experience (e.g., augmented reality and/or virtual reality), on the other hand, can use ambisonics, or spatial audio to indicate where sound is being generated. Ambisonics refers to a class of representations of spatial audio of different orders. Spatial audio of first order ambisonics generally utilizes of four channels of audio instead of two as in stereo audio: W, X, Y, and Z to provide sound in three dimensions. W is omnidirectional audio, meaning audio that is captured from every direction. X, Y, and Z are the channels of audio along the x axis, y axis, and z axis—in other words, left/right, up/down, and forward/backwards. It should be appreciated that other orders of spatial audio can use additional channels (e.g., second order ambisonics can use nine channels and third order ambisonics can use sixteen channels).

When generating a three-dimensional experience, the video component is often recorded separately from the audio component. For example, a camera capable of capturing a scene in three dimensions can be placed at a location to record a scene in multiple directions (e.g., 360 degrees or some subset of visualization in all directions) with the camera as a reference point. The camera can be oriented in a particular direction such that the camera has a perspective that some direction is left, up, forward, etc. so as a scene is captured, the video is oriented as such. An ambisonic microphone placed in a position to capture audio related to the scene can have its own orientation, separate from that of the camera, with its own notion of x, y, and z. In this way, recorded audio can have an orientation different from the orientation of the camera.

When listening to this audio in conjunction with viewing a related visual component, a user can wear a pair of headphones that track the user's orientation as the user's head turns. Knowing the orientation of the user's head allows spatial audio to be rendered to the user so different sounds that are encoded in the ambisonics recording will be adjusted (e.g., volume or frequency responses) such that the audio sounds like a stable audio scene in which the user is moving.

As such, aligning spatial audio captured by a microphone with captured video can provide a more immersive user experience. Accurately aligning spatial audio with video, however, can be difficult. Some conventional methods require loading video and ambisonics audio and, thereafter, using headphones while watching the video. To determine if the audio and video are correctly aligned, a user watches the video and listens to the sound to see if sounds seem to be in the right spot or not. However, relying on human perception of sound and direction often results in inaccurate alignment. Other conventional methods have attempted to create visual representations of spatial audio to assist with such alignment. Such methods can be used in the context of alternative reality, virtual reality, and/or mixed reality post-processing editing of recorded spatial audio. However, such methods often result in visual representations of sound that do not accurately indicate where sound is actually coming from. Additionally, such methods fail to use meaningful visual attributes based on properties of the spatial audio to create visual representations of sound(s) within the spatial audio.

SUMMARY

Embodiments of the present disclosure are directed towards a spatial audio visualization system for visualizing first order spatial audio using properties associated with time segments of the audio. In accordance with embodiments, such properties can include position, intensity, focus, and color. Advantageously, such a spatial audio visualization system is capable of clearly indicating where sound is coming from in an environment as well as visually representing properties of the sound that can be used to understand what objects might be generating the sound. As such, accurately visualizing spatial audio ensures alignment can be performed more quickly and accurately.

A spatial audio visualization system can provide visual representations of spatial audio using particles or blobs with attributes that reflect the properties of spatial audio over time. Position can be used to place the particle in the location sound is being captured from at a segment of time for the spatial audio. Intensity can be used to indicate how loud the sound is at a segment of time for the spatial audio by adjusting the opacity of the particle. Focus can be used to indicate how concentrated the sound is at a segment of time for the spatial audio by adjusting the size of the particle. Frequency can be used to indicate what pitch the sound is at during the segment of time for the spatial audio by displaying the particle using a color(s). To determine these properties, a time segment of spatial audio can be obtained and the various audio channels analyzed (W, X, Y, and Z) to identify position, intensity, focus, and frequency. Upon determining the properties across various time segments of the spatial audio, the audio can be rendered into a visualization using, for example, a particle that allows a user to "see" the sounds being made.

DETAILED DESCRIPTION

Oftentimes, users desire for easy alignment of spatial audio with any related visual component (e.g., related video). For instance, users might desire a visualization of spatial audio that will allow the user to easily view and understand properties related to the spatial audio. Accurately indicating a where sound is coming from and what object might be making the sound can allow a user to easily align audio with visual aspects. For instance, if a visual aspect shows two people talking, a man to the right and a woman to the left, a visual indication that sound is coming from a certain position on the left that has properties associated with a woman's voice, how she is speaking, etc. (e.g., loudness, frequency of the voice) can allow for easily aligning the spatial audio associated with the woman with visualizations of the woman talking.

Accordingly, embodiments of the present disclosure are directed to a spatial audio visualization system for visualizing time segments of spatial audio using properties of the spatial audio. In particular, and as described herein, properties can be determined for a selected time segment(s) of spatial audio. Such properties can include the position audio is coming from, the intensity of the audio, how focused the audio is, and the frequency of the audio. A time segment can be represented using a particle or blob. Each property can be conveyed to a user via a distinct visual aspect, or attribute, associated with a particle or blob. Advantageously, such presentation of properties of spatial audio at time segments allows users to visualize where sounds are coming from in a video at different times. As such, aligning the sound with corresponding objects in a video can be performed in a more efficient and effective manner.

Figure 1A:
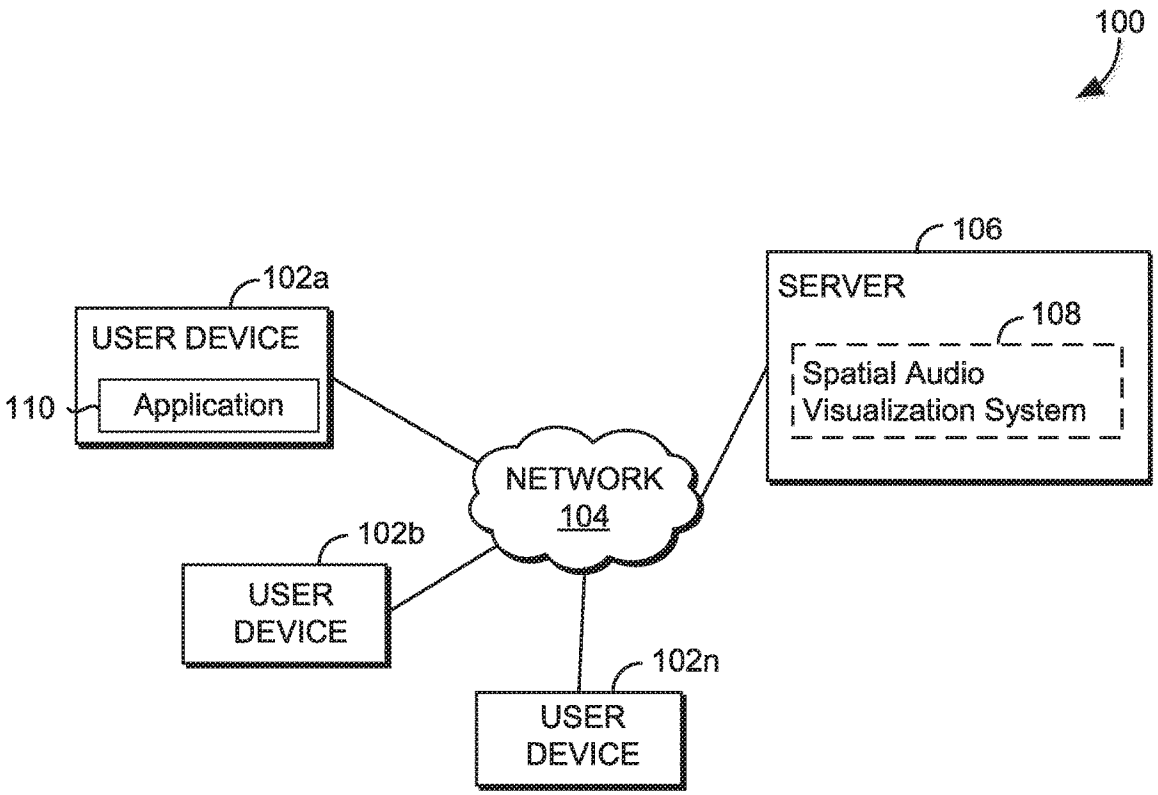
FIG. 1A depicts an example configuration of an operating environment in which some implementations of the present disclosure can be employed, in accordance with various embodiments of the present disclosure.

Turning to FIG. 1A, FIG. 1A depicts an example configuration of an operating environment in which some implementations of the present disclosure can be employed, in accordance with various embodiments of the present disclosure. It should be understood that this and other arrangements described herein are set forth only as examples. Other arrangements and elements (e.g., machines, interfaces, functions, orders, and groupings of functions, etc.) can be used in addition to or instead of those shown, and some elements may be omitted altogether for the sake of clarity. Further, many of the elements described herein are functional entities that may be implemented as discrete or distributed components or in conjunction with other components, and in any suitable combination and location. Various functions described herein as being performed by one or more entities may be carried out by hardware, firmware, and/or software. For instance, some functions may be carried out by a processor executing instructions stored in memory as further described with reference to FIG. 11.

It should be understood that operating environment 100 shown in FIG. 1A is an example of one suitable operating environment. Among other components not shown, operating environment 100 includes a number of user devices, such as user devices 102*a* and 102*b* through 102*n*, network 104, and server(s) 106. Each of the components shown in FIG. 1A may be implemented via any type of computing device, such as one or more of computing device 1100 described in connection to FIG. 11, for example. These components may communicate with each other via network 104, which may be wired, wireless, or both. Network 104 can include multiple networks, or a network of networks, but is shown in simple form so as not to obscure aspects of the present disclosure. By way of example, network 104 can include one or more wide area networks (WANs), one or more local area networks (LANs), one or more public networks such as the Internet, and/or one or more private networks. Where network 104 includes a wireless telecommunications network, components such as a base station, a communications tower, or even access points (as well as other components) may provide wireless connectivity. Networking environments are commonplace in offices, enterprise-wide computer networks, intranets, and the Internet. The network 104 may be any network that enables communication among machines, databases, and devices (mobile or otherwise). Accordingly, the network 104 may be a wired network, a wireless network (e.g., a mobile or cellular network), a storage area network (SAN), or any suitable combination thereof. In an example embodiment, the network 104 includes one or more portions of a private network, a public network (e.g., the Internet), or combination thereof. Accordingly, network 104 is not described in significant detail.

It should be understood that any number of user devices, servers, and other components may be employed within operating environment 100 within the scope of the present disclosure. Each may comprise a single device or multiple devices cooperating in a distributed environment.

User devices 102*a* through 102*n* can be any type of computing device capable of being operated by a user. For example, in some implementations, user devices 102*a* through 102*n* are the type of computing device described in relation to FIG. 11. By way of example and not limitation, a user device may be embodied as a personal computer (PC), a laptop computer, a mobile device, a smartphone, a tablet computer, a smart watch, a wearable computer, a personal digital assistant (PDA), an MP3 player, a global positioning system (GPS) or device, a video player, a handheld communications device, a gaming device or system, an entertainment system, a vehicle computer system, an embedded system controller, a remote control, an appliance, a consumer electronic device, a workstation, any combination of these delineated devices, or any other suitable device.

The user devices can include one or more processors, and one or more computer-readable media. The computer-readable media may include computer-readable instructions executable by the one or more processors. The instructions may be embodied by one or more applications, such as application 110 shown in FIG. 1A. Application 110 is referred to as a single application for simplicity, but its functionality can be embodied by one or more applications in practice. As indicated above, the other user devices can include one or more applications similar to application 110.

The application(s) may generally be any application capable of facilitating the exchange of information between the user devices and the server(s) 106 in carrying out spatial audio visualization. In some implementations, the application(s) comprises a web application, which can run in a web browser, and could be hosted at least partially on the server-side of environment 100. In addition, or instead, the application(s) can comprise a dedicated application, such as an application having audio editing and/or processing functionality. For example, such an application can be configured to display visualizations of spatial audio. Such an application can also be capable of having visual and/or video editing and/or processing functionality (e.g., where the visual and/or video is associated with the audio). In some cases, the application is integrated into the operating system (e.g., as a service). It is therefore contemplated herein that "application" be interpreted broadly. Example applications include Adobe® Audition, Adobe® Premiere Pro, and the like.

In accordance with embodiments herein, application 110 can facilitate visualizing spatial audio. In particular, a user can select or input a spatial audio recording and/or spatial audio sound clip. A spatial audio recording generally refers to a recording of first order spatial audio with four channels of audio capturing sound from three dimensions: W, X, Y, and Z. A spatial audio sound clip can generally refer to a file containing four channels of audio capturing sound from three dimensions: W, X, Y, and Z. A spatial audio recording and/or spatial audio sound clip can also be referred to as spatial audio. The W channel contains omnidirectional audio, meaning audio that is captured from every direction. The X, Y, and Z channels of audio contain audio along the x axis, y axis, and z axis—in other words, sounds coming from left/right, up/down, and forward/backwards. Spatial audio can be selected or input in any manner. The application may facilitate the access of one or more recordings or sound clips stored on the user device 102*a* (e.g., in an audio library), and/or import spatial audio from remote devices 102*b*-102*n* and/or applications, such as from server 106. For example, a user may record spatial audio using a microphone on a device, for example, user device 102*a*. As another example, a user may select a desired spatial audio sound clip from a repository, for example, stored in a data store accessible by a network or stored locally at the user device 102*a*. Based on the input spatial audio, the input spatial audio can be analyzed to generate a visualization of the spatial audio, for example, using various techniques described herein. Such a visualization of the spatial audio can be provided to the user device 102*a*. To this end, the sound visualization can be rendered for display to a user using attributes relating to determined properties of sound at time segments of the spatial audio (e.g., via user device 102*b*-102*n*). Such a visualization can be rendered using a particle with attributes based on the determined properties. Particle(s) can be displayed using a two-dimensional and/or three-dimensional visualization. It should be appreciated that attributes related to determined properties for sound can be displayed in any number of ways.

The user device can communicate over a network 104 with a server 106 (e.g., a Software as a Service (SAAS) server), which provides a cloud-based and/or network-based spatial audio visualization system 108. The spatial audio visualization system may communicate with the user devices and corresponding user interface to facilitate the editing and/or presenting of sound visualizations via the user device using, for example, application 110.

As described herein, server 106 can facilitate visualizing spatial audio via spatial audio visualization system 108. Server 106 includes one or more processors, and one or more computer-readable media. The computer-readable media includes computer-readable instructions executable by the one or more processors. The instructions may optionally implement one or more components of spatial audio visualization system 108, described in additional detail below.

For cloud-based implementations, the instructions on server 106 may implement one or more components of spatial audio visualization system 108. Application 110 may be utilized by a user to interface with the functionality implemented on server(s) 106, such as spatial audio visualization system 108. In some cases, application 110 comprises a web browser. In other cases, server 106 may not be required, as further discussed with reference to FIG. 1B.

Thus, it should be appreciated that spatial audio visualization system 108 may be provided via multiple devices arranged in a distributed environment that collectively provide the functionality described herein. Additionally, other components not shown may also be included within the distributed environment. In addition, or instead, spatial audio visualization system 108 can be integrated, at least partially, into a user device, such as user device 102*a*.

Figure 1B:
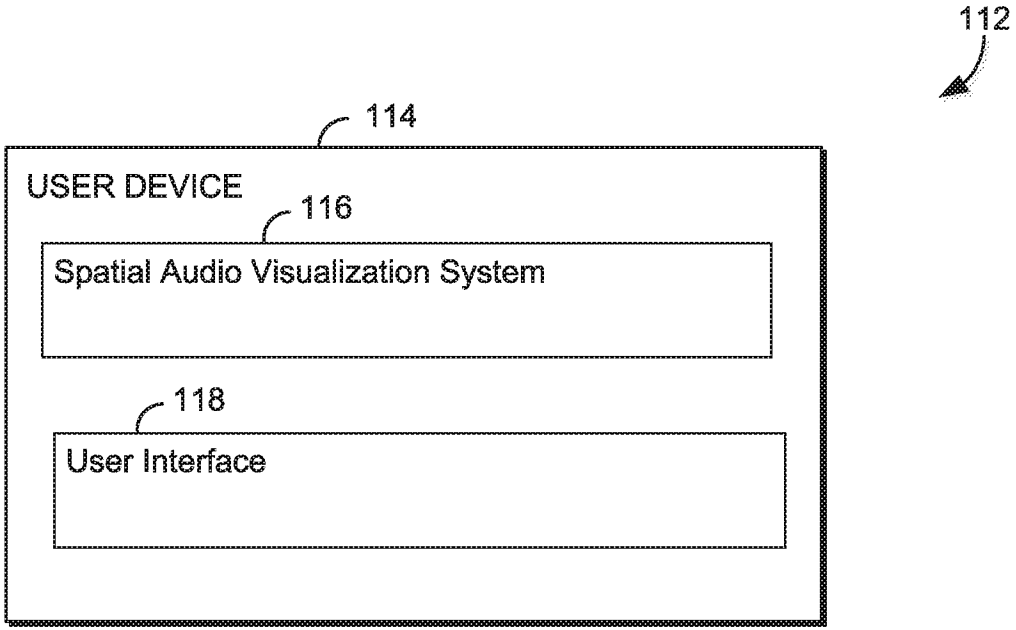
FIG. 1B depicts an example configuration of an operating environment in which some implementations of the present disclosure can be employed, in accordance with various embodiments of the present disclosure.

Referring to FIG. 1B, aspects of an illustrative spatial audio visualization system are shown, in accordance with various embodiments of the present disclosure. FIG. 1B depicts a user device 114, in accordance with an example embodiment, configured to allow for visualizing spatial audio. The user device 114 may be the same or similar to the user device 102*a*-102*n* and may be configured to support the spatial audio visualization system 116 (as a standalone or networked device). For example, the user device 114 may store and execute software/instructions to facilitate interactions between a user and the image editing system 116 via the user interface 118 of the user device.

A user device can be utilized by a user to facilitate visualization of spatial audio. In particular, a user can select or input spatial audio for visualization utilizing user interface 118. Spatial audio can be selected or input in any manner. The user interface may facilitate the user accessing one or more stored recordings and/or sound clips of spatial audio on the user device (e.g., in an audio library), and/or import recordings and/or sound clips from remote devices and/or applications. Based on the input recordings and/or sound clips, the spatial audio can be analyzed to generate a visualization using various techniques, some of which are further discussed below with reference to spatial audio visualization system 204 of FIG. 2.

Figure 2:
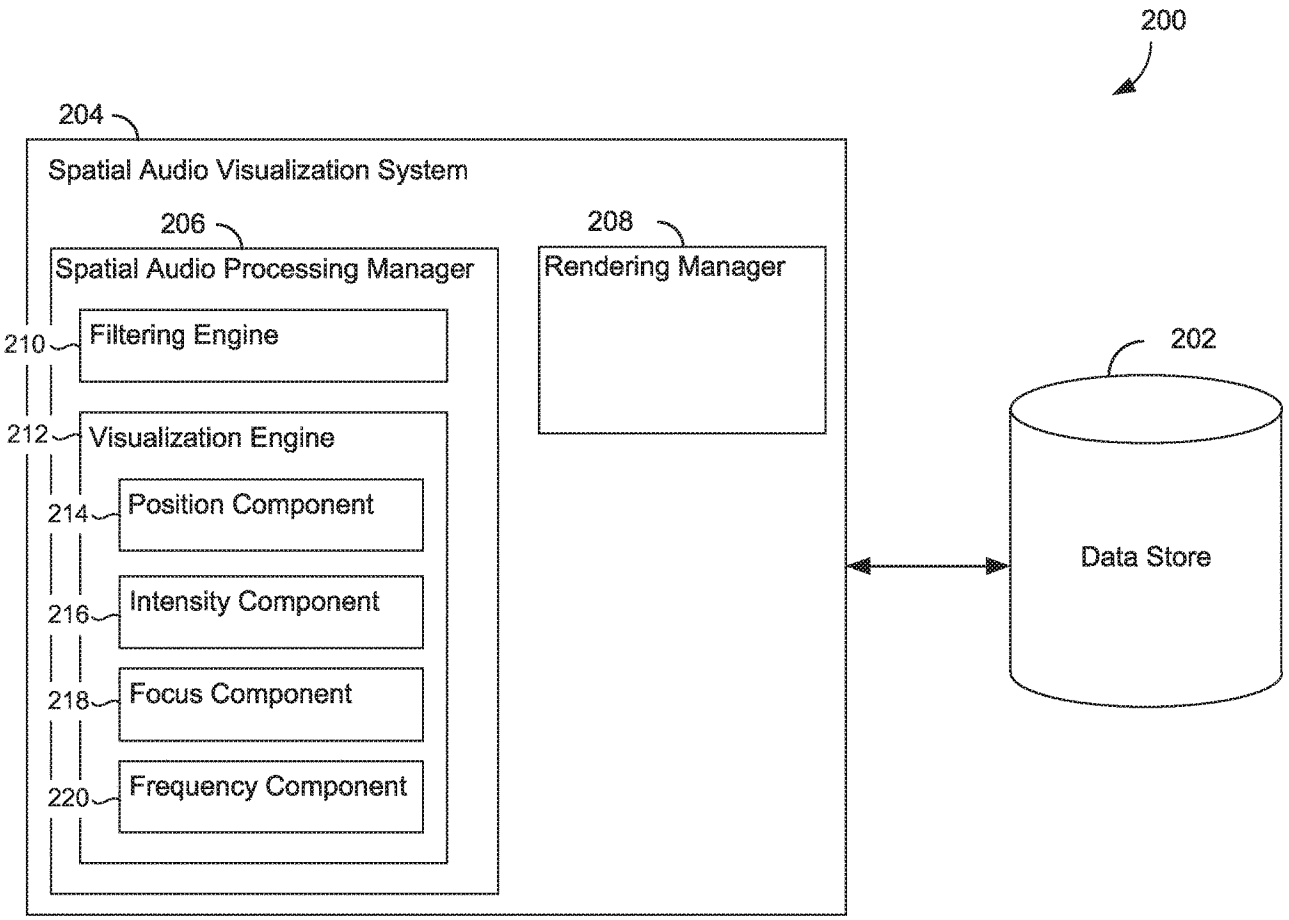
FIG. 2 depicts aspects of an illustrative spatial audio visualization system, in accordance with various embodiments of the present disclosure.

Referring to FIG. 2, aspects of an illustrative spatial audio visualization environment 200 are shown, in accordance with various embodiments of the present disclosure. Spatial audio visualization system 204 includes spatial audio processing manager 206 and rendering manager 208. The foregoing managers of spatial audio visualization system 204 can be implemented, for example, in operating environment 100 of FIG. 1A and/or operating environment 112 of FIG. 1B. In particular, those managers may be integrated into any suitable combination of user devices 102*a* and 102*b* through 102*n* and server(s) 106 and/or user device 114. While the spatial audio processing manager and rendering manager are depicted as separate managers, it should be appreciated that a single manager can perform the functionality of both managers. Additionally, in implementations, the functionality of the managers can be performed using additional managers, engines, and/or components. Further, it should be appreciated that the functionality of the managers can be provided by a system separate from the spatial audio visualization system.

As shown, a spatial audio visualization system can operate in conjunction with data store 202. Data store 202 can store computer instructions (e.g., software program instructions, routines, or services), data, and/or models used in embodiments described herein. In some implementations, data store 202 can store information or data received via the various managers, engines, and/or components of spatial audio visualization system 204 and provide the various managers, engines, and/or components with access to that information or data, as needed. Although depicted as a single component, data store 202 may be embodied as one or more data stores. Further, the information in data store 202 may be distributed in any suitable manner across one or more data stores for storage (which may be hosted externally).

In embodiments, data stored in data store 202 can include spatial audio recordings and/or spatial audio sound clips selectable for visualization using, for example, the spatial audio visualization system. Spatial audio can be captured using an ambisonic microphone and is first order spatial audio can be comprised of four channels: W, X, Y, and Z. W is an omnidirectional channel containing audio captured from every direction (e.g., the x, y, and z directions). The X, Y, and Z channels contain sound captured along the x axis, y axis, and z axis (e.g., left/right, up/down, and forward/backwards). Such spatial audio can be input into data store 202 from a remote device, such as from a server or a user device. Data stored in data store 202 can also include visualization aspects determined for a spatial audio time segment. Determined properties for spatial audio can also be stored in data store 202. Such properties can include position, intensity, focus, and frequency for the sound at segments of time of the spatial audio. Data stored in data store 202 can further include rendered visualizations for spatial audio. Such rendered visualizations of spatial audio can be based on spatial audio properties.

Spatial audio visualization system 204 can generally be used to visualize spatial audio. Specifically, the spatial audio visualization system can be configured for determining properties of the audio for time segments of the spatial audio. As used herein, performing spatial audio visualization generally includes analyzing the spatial audio at a time segment to determine properties of the audio for that time segment that can be used to render a visualization of the audio at that time segment using attributes based on the determined properties of the sound. Upon determining properties for time segments, spatial audio can be visualized for an entire recording and/or clip, or a portion thereof. Such properties can include position, intensity, focus, and frequency of sound(s) present during the time segment(s) of spatial audio. Position can indicate where sound is coming from on the surface of the unit sphere during the time segment of audio. Intensity can indicate how much energy (e.g., noise) is occurring during the time segment of audio. Focus can indicate how concentrated the sound is during the time segment of audio. Frequency can indicate what pitch the sound is during the time segment of audio.

A spatial audio recording and/or audio clip can be accessed or referenced by spatial audio processing manager 206 for visualizing the audio. In this regard, the spatial audio processing manager 206 may access or retrieve spatial audio selected by a user via data store 202 and/or from a remote device, such as from a server or a user device. As another example, the spatial audio processing manager 206 may receive spatial audio provided to the spatial audio processing manager 206 via a user device. Visualization of spatial audio can be initiated in any number of ways. For example, visualization can take place when a user indicates a desire to select spatial audio for viewing using, for example, a user interface associated with the spatial audio visualization system. As another example, visualization may be initiated automatically, for instance, upon receiving and/or retrieving spatial audio. In some embodiments, such selection can be for presenting the selected spatial audio and/or for performing the spatial audio visualization.

As shown, the spatial audio processing manager 206 can include filtering engine 210 and visualization engine 212. The foregoing engines of the spatial audio processing manager can be implemented, for example, in operating environment 100 of FIG. 1A and/or operating environment 112 of FIG. 1B. In particular, these engines may be integrated into any suitable combination of user devices 102*a* and 102*b* through 102*n* and server(s) 106 and/or user device 114. It should be appreciated that while filtering engine and visualization engine are depicted as a separate engines, in implementations, the functionality of these engines can be performed using a single engine and/or additional engines.

Upon the selection of spatial audio for visualization, filtering engine 210 can be utilized to filter the spatial audio. Filtering can take place during the visualization process because there can be a lot of noise captured in the spatial audio that makes sound(s) difficult to understand. For instance, the human audio response goes up to around 22 kHz, however, the sounds that people typically care about and perceive are typically in a sound range between 1 Hz and 1 kHz. As such, filtering engine 210 can be used to perform preprocessing of spatial audio by filtering to remove sounds greater than 1 kHz. This filtering can reduce the noise level before any further processing occurs, helping to keep the visualization clean. The filtering engine can carry out the filtering of spatial audio using, for example, a 1 kHz low pass filter or bandpass filter. As can be appreciated, in some cases, the range of sound that is filtered can vary based on the noises and/or sounds that are captured in the spatial audio. As such, the filter is capable of being adjusted to provide an optimal range of audio for visualization (e.g., when spatial audio includes sounds a user wishes to visualize over 1 kHz, the filter can be increased to, for example, 1.5 kHz).

As shown, visualization engine 212 can include position component 214, intensity component 216, focus component 218, and color component 220. The foregoing components of the visualization engine can be implemented, for example, in operating environment 100 of FIG. 1A and/or operating environment 112 of FIG. 1B. In particular, these components may be integrated into any suitable combination of user devices 102*a* through 102*n* and server(s) 106 and/or user device 114. It should be appreciated that while position component, intensity component, focus component, and color component are depicted as a separate components, in implementations, the functionality of the components can be performed using a single component and/or additional components.

Visualization engine 212 can be utilized to analyze spatial audio to determine properties of sound(s) for time segments of the spatial audio. Such properties can include position, intensity, focus, and frequency. Position can indicate where sound is coming from on the surface of the unit sphere during a time segment of audio. Intensity can indicate how much energy (e.g., noise) is occurring during a time segment of audio. Focus can indicate how concentrated the sound is during a time segment of audio. Frequency can indicate what pitch the sound is during a time segment of audio. Upon determining properties for a time segment, such properties can be combined for full visualization of spatial audio over time using attributes based on the determined properties. For instance, position can be represented using coordinates at which the visualization is displayed, intensity can be represented using opacity of the visualization, focus can be represented using size of the visualization, and frequency can be represented using a RGB color(s) for the visualization.

The visualization engine 212 can segment selected spatial audio into time segments for processing. In one embodiment, the audio is segmented into chunks of time on the order of 10 ms. A frame of video typically has 30 frames per second and there is typically 48 kH of audio captured per second. As such, using time segments of 10 ms allows for 10 visualizations of sound to be displayed for each frame of video such that each 10 ms segment of spatial audio includes 480 audio samples where an audio sample has a 16 bit value per point in time as a wave form. As can be appreciated, audio can be segmented into any time segments (e.g., dynamically determined time segments, default time segments, user-specified time segments, etc.).

Position component 214 can be configured to determine the position of sound at a selected time segment of spatial audio. Position can indicate where on the surface of the unit sphere sound is coming. In embodiments, position can designate where in a three-dimensional environment, as shown using augmented reality and/or virtual reality, sound is coming from at a point in time (e.g., when a user in a virtual reality environment is facing a certain direction, position of sound can be used to indicate that a person is clapping behind and to the left of the user; if the user is on a hill in the virtual reality environment, the position of sound can further indicate that the clapping is coming from below—or downhill from—the user). As such, position can be used to indicate what location, or coordinates, sound should be placed at for a visualization of a time segment of spatial audio.

Sound at a selected time segment of first order spatial audio has four channels of audio: W, X, Y, and Z. The W channel contains omnidirectional audio, meaning audio that is coming through from every direction. X, Y, and Z are the channels of audio along the x axis, y axis, and z axis—in other words, left/right, up/down, and forward/backward. To determine the three-dimensional position of sound at a selected segment of spatial audio includes identifying the x, y, and z position. To identify an accurate position along an axis, corresponding W channel audio from along the designated axis can be incorporated. In an embodiment, the omnidirectional component W can be incorporated into the axis component(s) by taking the root mean square error (RMSE) of the sum of W plus X/Y/Z and subtracting the RMSE of the sum of W minus X/Y/Z. Such exemplary equations can be designated as follows:

$$x=(\mathrm{RMSE}(W+X))-(\mathrm{RMSE}(W-X))$$

$$y=(\mathrm{RMSE}(W+Y))-(\mathrm{RMSE}(W-Y))$$

$$z=(\mathrm{RMSE}(W+Z))-(\mathrm{RMSE}(W-Z))$$

The above equations can be used to determine the three-dimensional position of sound at a time segment because the W component is omnidirectional and when the X/Y/Z is positive it means the sound is to the right/up/forward and, when negative, the sound is to the left/down/backward.

Using such equations is advantageous because it takes into account the directional components of sound. Sound in an audio wave form goes back and forth in direction (e.g., both a right/up/forward direction and a left/down/backward direction depending on the channel). Sound in an audio wave appears to have energy in two directions—the direction of the actual sound source and 180 degrees out of phase with the actual sound source. Equations, as above, allow for computation of the amount of energy in one direction and the amount of energy in the opposite direction. When the outcome of the computation is zero that means the source of the sound is in the center of that axis. When the sound is positive, the source of the sound is occurring in a corresponding positive direction. The distance, extent, or how far in that direction is based on how positive the computation is (e.g., positive ½ is slightly in positive direction, 1 is all the way in the positive direction). When sound is negative, the source of the sound is in corresponding negative direction. The distance, extent, or how far in that direction is based on how negative the computation is (e.g., negative ½ is slightly in negative direction, 1 is all the way in the negative direction). Examples of positive directions can be right for the x axis, up for the y axis, and forward for the z axis. Examples of negative directions can be left for the x axis, down for the y axis, and backward for the z axis.

Upon determining x, y, z, the positions of sound can be combined to designate the three-dimensional position of sound from the time segment of spatial audio as a vector: v=<x, y, z>. When such a vector is not of unit length, the vector can be normalized to a position on the unit sphere that can be used to accurately visualize the position of sound using coordinates at a location. The normalized vector can then be used to display the sound for the spatial audio for the selected time segment at a location based on, for instance, the x, y, and z coordinates.

Intensity component 216 can be configured to determine the intensity of sound at a selected time segment of spatial audio. Intensity can indicate how much energy (e.g., noise) is occurring during a time segment of audio. In embodiments, intensity indicates how loud sound is for the spatial audio for the selected time segment. As such, intensity can be designated using decibels. Decibels can measure the intensity of a sound or the power level of an electrical signal by comparing it with a given level on a logarithmic scale. As such, intensity can be represented using opacity based on the determined decibels of sound.

To determine intensity for sound at a selected time segment of spatial audio, the W (omnidirectional) channel can be used. In embodiments, all of the sound occurring in a scene can be encoded in the W channel. When there are no spatial components of sound, the W channel can have all the audio and the x, y, z channels will be 0. When audio is 100% spatialized, for example, in the x direction, all the audio will be in the W and X audio channels. In this way, for such embodiments, the W channel can store all captured sound. As such, the intensity of sound for a time segment of spatial audio can be determined using the RMSE of the W channel which is then converted to decibels using a log function. Such an exemplary equation can be designated as follows:

$$I=20\times\log(\mathrm{RMSE}(W))$$

Focus component 218 can be configured to determine the focus of sound at a selected time segment of spatial audio. Focus can indicate how concentrated sound is during the time segment. Focus can also be described as an extent to which the sound is spread. In embodiments, focus designates how diffuse the sound is within the environment. For example, when outside in a quiet place, a highly focused sound would occur when a microphone captures a tiny bell ringing. In another example, a large gong close to the microphone would generate audio on every point on surface so the gong would create a very large sound this is highly unfocused. However, if such a gong moves farther away from the microphone, the angular distance will be smaller so the gong sound would become more focused. In still a further example, when inside a room, room response such as walls causing echo and/or reverb are captured, in such an instance, a tiny bell would cause reflections of its sound off the walls creating a more diffuse sound at a microphone. As such, focus can be represented using size based on how the sound is focused.

To determine focus for sound at a selected time segment of spatial audio, v can be used—the vector comprised of the x, y, and z positions of sound. Prior to normalizing the vector, it has a length between 0 and 1. When the length is 0, x, y, and z are all 0 and there is no spatial aspect of the sound, the sound is only omnidirectional so v=<0, 0, 0>. When the length is 1, there is an extreme spatial component to the sound, not just that sound is coming from a certain direction but that the sound is entirely coming from that direction and there is not any audio in any other direction—a very focused spatial sound. When the length of a vector is one half, then the sound is in between an omnidirectional sound and a single directional sound, in other words, the sound is a unidirectional sound. As such, focus can be determined using the length of v, the x, y, z vector. An exemplary equation for determining focus can be designated as follows:

$$F=\sqrt{x^2+y^2+z^2}$$

Frequency component 220 can be configured to determine the frequency of sound at a selected time segment of spatial audio. Color can be assigned to sound based on the frequency of the sound, similar to the way that frequency of light has an associated color. As such, color can be used to indicate what frequency of sound occurs during the time segment of spatial audio. In this way, color can be used as a visual element to help users identify what object might be making a sound to aid in alignment of the sound with a visual component (e.g. an object making a base sound, such as a truck engine, versus an object making a high pitch sound, such as a fire alarm).

In embodiments, frequency can be determined by using a frequency spectrum of sound for a selected time segment of spatial audio. The frequency spectrum of sound can be analyzed using fast Fourier transform (FFT). FFT can be used to create bands around a frequency of a given sinusoid to designate frequency bins that are even in size, non-overlapping, and cover the whole spectrum. Using FFT, a frequency spectrum can be mapped to a RGB (Red-Green-Blue) color by defining three color matching functions. As such, a color matching function can be an array of weights per frequency bin in the FFT so that the computed spectrum is multiplied per-element by the color matching function to determine the intensity of that color.

In an embodiment, the defined minimum and maximum frequency are respectively, 0 Hz and 1 kHz with defined peak response frequencies for red at 125 Hz, green at 500 Hz, and blue at 875 Hz. The color matching functions for each color go linearly from 0 to the peak response and then back to 0. Such a frequency range is capable of being increased or decreased based on the attributes of sound to visualize from the spatial audio. The peak response frequencies can be adjusted based on the minimum and maximum frequency to ensure that the distribution of color is equally distributed across the entire range.

Assigning color to sound based on frequency creates a visual indication of the property of frequency of sound by using color(s) to indicate meaningful audio ranges (e.g., perceptually low-frequency sounds such as bass, engines, rumbling, etc. will be indicated using red, mid-frequency sounds can be indicated using yellow-green, and high-frequency sounds can be indicated using blue, and white noise such as a hiss, clap, crash, etc. can be indicated using white). Color can also indicate sounds that are "white noise" or include all frequencies—red, blue, and green. Such white noises can be designated using white, or all the colors overlapped.

Once at least one property at a time segment have been determined (e.g., location, intensity, focus and color), rendering manager 208 can be used to render a visualization of spatial audio utilizing the properties of the spatial audio. Such properties can be determined, for example, using visualization engine 212 of spatial audio processing manager 206. A time segment of the spatial audio can be rendered into a visualization using a particle or blob (e.g., when 10 ms time segments are used, a single rendered frame can result in the visualization of 10 distinct particles). Such a particle(s) can be generated by mapping the determined properties. A particle can be displayed at coordinates using the determined position where sound is estimated to be originating. Determined intensity can be used to indicate how much energy is associated with a particle. Such intensity can be indicated using opacity. Determined focus indicates the concentration of sound for a particle using size. Color can be used to indicate the frequency of the particle. Color can be displayed using RGB based on the frequency at the time segment indicated by the particle. In another embodiment, color can be displayed using up to three particles for each time segment where one particle indicates "blue," one "green," and another "red." In such an embodiment, a single rendered frame can result in a visualization of up to 30 distinct particles, one red, one green, and one blue for each segment of time depending on the frequency composition of the segment of spatial audio. Determined properties for sound can be displayed in any number of ways, such as by displaying the properties using attributes of the rendered visualization.

Figure 3:
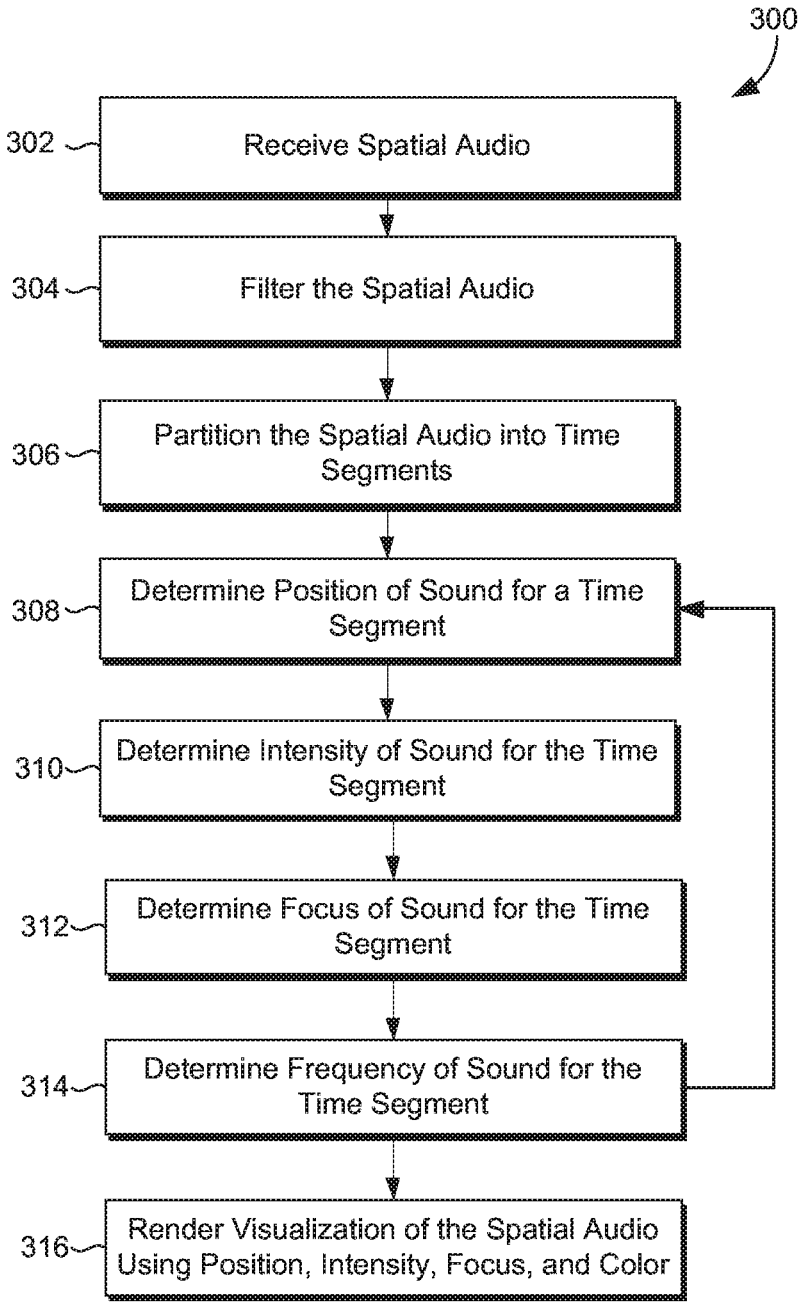
FIG. 3 illustrates a process flow showing an embodiment for performing visualization of spatial audio, in accordance with embodiments of the present invention.

With reference to FIG. 3, a process flow is provided showing an embodiment of method 300 for visualizing spatial audio, in accordance with embodiments of the present invention. Method 300 can be performed, for example by spatial audio visualization system 204, as illustrated in FIG. 2.

At block 302, spatial audio is received. Such spatial audio can be received from a database, such as data store 202 of FIG. 2. Spatial audio can mean that there are four channels of audio instead of two as in stereo audio: W, X, Y, and Z (e.g., first order spatial audio). W is omnidirectional audio, meaning audio that is coming through from every direction.

X, Y, and Z are the channels of audio along the x axis, y axis, and z axis—in other words, left, right, forward, back, and up and down.

At block 304, the spatial audio can be filtered. Filtering can be performed using, for example, filtering engine 210 as depicted in FIG. 2. Filtering can take place during the visualization process to help keep the visualization clean. Spatial audio can be filtered using, for example, a 1 kHz low pass filter or bandpass filter, as the sounds people typically care about and perceive are in a sound range between 1 and 1 kHz. However, in some cases, the range of sound that is filtered can vary based on the noises and/or sounds that are captured in the spatial audio, widening or narrowing the range of filtered spatial audio. As such, the filter is capable of being adjusted to provide the optimal range of audio for visualization. Preprocess filtering of spatial audio can reduce the noise level before any further processing occurs.

At block 306, spatial audio can be partitioned into time segments. Audio can be partitioned, for example, into chunks of time on the order of 10 ms. A frame of video typically has 30 frames per second, as such, using time segments of 10 ms allows for 10 visualizations of sound for each frame of video. In an embodiment, a visualization of sound can be displayed using, for example, a particle or blob. The properties associated with sound for each visualization can be used to assign particular attributes to such a particle.

At block 308, the position of sound can be determined for a time segment. Position can indicate where in a three-dimensional environment sound is coming from at a point in time. Such position can be determined by incorporating the omnidirectional component W into axis component(s) for a time segment of spatial audio to determine an x, y, z position. One manner of determining the position of sound for a time segment is by taking the RMSE of the sum of W plus X/Y/Z and subtracting the RMSE of the sum of W minus X/Y/Z. Using such an equation is advantageous because it takes into account the directional component of sound. Upon determining x, y, z, the positions of sound can be combined to designate the three-dimensional position of sound as v=<x, y, z>. When such a vector is not of unit length, the vector can be normalized to a position on the unit sphere. The normalized vector can then be used to indicate the position of the sound for the spatial audio for the selected time segment.

At block 310, the intensity of sound can be determined for the time segment. Intensity can indicate how much energy (e.g., noise) is occurring during a time segment of audio. As such, intensity can be designated using decibels as can measure the intensity of a sound or the power level of an electrical signal by comparing it with a given level on a logarithmic scale. The W (omnidirectional) channel can be used to determine intensity. As such, the intensity of sound for a time segment of spatial audio can be determined using the RMSE of the W channel which is then converted decibels using a log function.

At block 312, the focus of sound can be determined for the time segment. Focus can indicate how concentrated, spread out, or diffuse sound is within the environment at a time segment of spatial audio. To determine focus, the vector v comprised of the x, y, and z positions of sound can be used. Analyzing the value of the position along each axis, allows for determining how focused of a position sound is coming from.

At block 314, the color of sound can be determined for the time segment. Color can be assigned to sound based on the frequency of the sound. Color can be used as a visual element to help users identify what object in a video might be making a sound to aid in alignment of the sound with the video (e.g. an object making a base sound versus an object making a high pitch sound). Color can be determined by taking the frequency spectrum of sound for a selected time segment of spatial audio using FFT. The frequency spectrum can then be mapped to a RGB color using defined color matching functions for red, blue, and green. In an embodiment, the defined minimum and maximum frequency are respectively, 0 Hz and 1 kHz with defined peak response frequencies for red at 125 Hz, green at 500 Hz, and blue at 875 Hz. The color matching functions for each color go linearly from 0 to the peak response and then back to 0. Such a frequency range is capable of being increased or decreased based on the attributes of sound to visualize from the spatial audio.

Steps 308-314 can be repeated for additional time segment(s) of spatial audio based on the number of time segments partitioned at block 306. In other embodiments, some partitioned segments will not be used in the visualization process; instead specific frames can be identified as displaying important sounds. These identified frames can be processed for visualization.

At block 316, a visualization for spatial audio can be rendered using determined position, intensity, focus, and color. A time segment of the spatial audio can be rendered using a particle or blob. For instance, when 10 ms time segments are used, a single rendered frame can have 10 distinct particles, though it should be appreciated that such particles can overlap resulting in the appearance of less than 10 particles. Such a particle(s) can be generated by mapping the determined properties for time segments of spatial audio. A particle can be displayed at the position where sound is determined to be originating. Determined intensity can be used to indicate how much energy a particle has. Such intensity can be indicated using opacity. Determined focus indicates how concentrated sound for a particle. Color can be used to indicate the frequency of the particle. When all the properties for each time segments are rendered together, a visualization of the spatial audio is generated. This overall visualization can be played along with any related visual component. Depicting spatial audio using particles that indicate properties of sound can help with aligning the spatial audio with its related visual aspects. In some embodiments, it should be appreciated that instead of a time segment being displayed using a single particle, up to three particles can be used to represent each time segment such that the three particles indicate "blue," "green," and "red." In such an embodiment, a single rendered frame can result in the visualization of up to 30 distinct particles.

Figure 4:
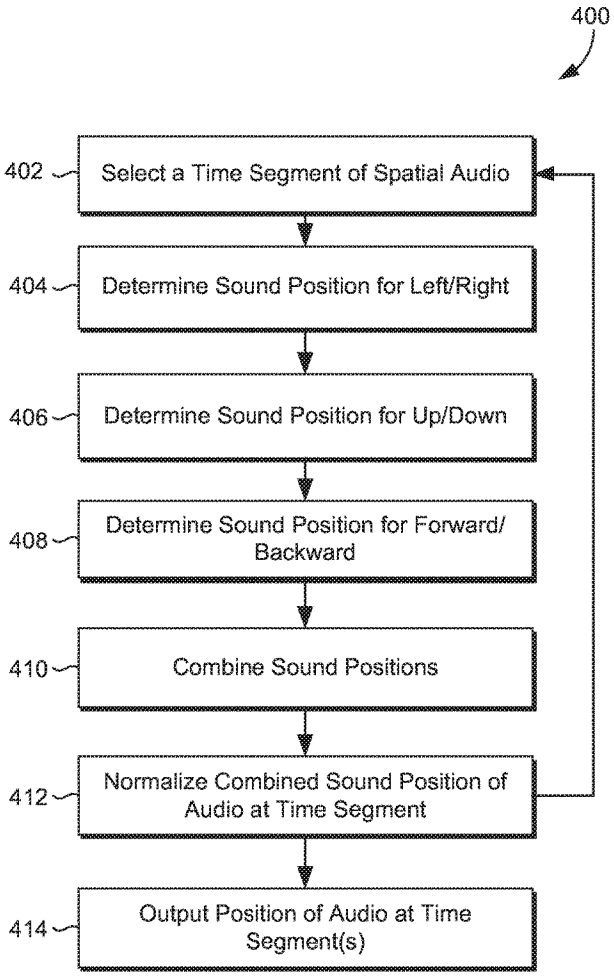
FIG. 4 illustrates a process flow showing an embodiment for determining the position of sound for a time segment of spatial audio, in accordance with embodiments of the present invention.

With reference to FIG. 4, a process flow is provided showing an embodiment of method 400 for determining position of sound of time segment(s) of spatial audio, in accordance with embodiments of the present invention. Method 400 can be performed, for example by position component 214 of spatial audio visualization system 204, as illustrated in FIG. 2.

At block 402, a time segment of spatial audio can be selected to determine the position of sound for that time segment. The sound at a selected segment of first order spatial audio has four channels of audio: W, X, Y, and Z. The W channel is omnidirectional audio, meaning audio that is coming through from every direction. X, Y, and Z are the channels of audio along the x axis, y axis, and z axis—in other words, left/right, forward/backward, and up/down.

At block 404, the sound position can be determined for left/right, or in the x axis. An accurate position along an axis requires incorporating corresponding W channel audio along the x axis. The omnidirectional component W can be incorporated into the axis component(s) by taking the RMSE of the sum of W plus X and subtracting the RMSE of the sum of W minus X. Such an exemplary equation can be designated as: x=(RMSE (W+X))−(RMSE (W−X)). When x is positive it means the sound is to the right and when x is negative the sound is to the left. Upon determining x, the position of sound can be used to as the x axis position of a sound vector for the position of spatial audio at the time segment.

At block 406 the sound position can be determined for up/down, or in the y axis. An accurate position along an axis requires incorporating corresponding W channel audio along the y axis. The omnidirectional component W can be incorporated into the axis component(s) by taking the RMSE of the sum of W plus Y and subtracting the RMSE of the sum of W minus Y. Such an exemplary equation can be designated as: y=(RMSE (W+Y))−(RMSE (W−Y)). When y is positive it means the sound is to the right and when y is negative the sound is to the left. Upon determining y, the position of sound can be used to as the y axis position of a sound vector for the position of spatial audio at the time segment.

At block 408 the sound position can be determined for forward/backward, or in the z axis. An accurate position along an axis requires incorporating corresponding W channel audio along the z axis. The omnidirectional component W can be incorporated into the axis component(s) by taking the RMSE of the sum of W plus Z and subtracting the RMSE of the sum of W minus Z. Such an exemplary equation can be designated as: z=(RMSE (W−Z))−(RMSE (W+Z)). When z is positive it means the sound is to the right and when z is negative the sound is to the left. After determining z, the position of sound can be used to as the z axis position of a sound vector for the position of spatial audio at the time segment.

Upon determining the x, y, and z, at bock 410, these positions can be combined to determine the three-dimensional position of sound using a vector: v=<x, y, z>. When v is not of unit length, at block 412, the vector can be normalized to a position on the unit sphere. The normalized vector can then be used to indicate the position of the sound for the spatial audio for the selected time segment.

Blocks 402 through 412 can be repeated as necessary to determine the position of sound for additional time segments of spatial audio. When the position of sound for addition time segments of spatial audio are not needed, at block 414, the position of audio can be output for the time segment(s) that position was determined for the spatial audio.

Figure 5:
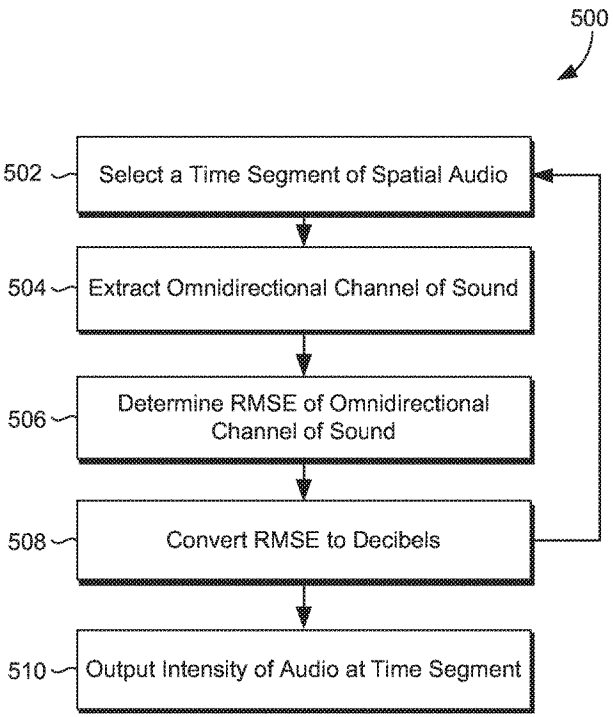
FIG. 5 illustrates a process flow showing an embodiment for determining the intensity of sound for a time segment of spatial audio, in accordance with embodiments of the present invention.

With reference to FIG. 5, a process flow is provided showing an embodiment of method 500 for determining intensity of sound for time segment(s) of spatial audio, in accordance with embodiments of the present invention. Method 500 can be performed, for example by intensity component 216 of spatial audio visualization system 204, as illustrated in FIG. 2.

At block 502, a time segment of spatial audio can be selected to determine the intensity of sound for that time segment. The selected time segment can be, for example, the same time segment selected at block 402 to determine position.

At block 504, the W omnidirectional channel of sound can be extracted at the time segment of spatial audio. Because W is omnidirectional, the channel has audio that captured from every direction (e.g., x, y, and z). As such, the omnidirectional channel can be used to determine intensity of sound during a time segment of spatial audio. Using the omnidirectional channel can indicate how spatialized audio is based on how much sound is stored in the channel. For instance, when all of the sound occurring in a scene is encoded in the W channel, there is no spatial component of sound and the W channel will have all the audio with the x, y, and z channels having zero. When audio is 100% spatialized in the x direction, all the audio will be in the W and X audio channels.

To utilize the omnidirectional channel of audio to indicate focus, at block 506, the RMSE of the channel can be taken. At block 508, the RMSE can be converted to decibels. This conversion can use a log function such that I=20×log(RMSE (W)). Blocks 502 through 508 can be repeated as necessary for additional time segments of spatial audio to determine the intensity of sound for additional time segments. At block 510, the intensity of audio can be output for the time segment(s) that intensity was determined for the spatial audio.

Figure 6:
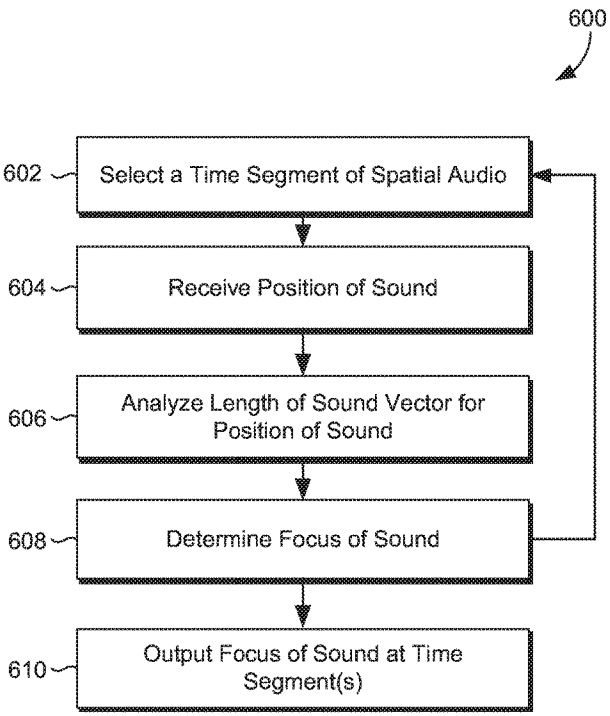
FIG. 6 illustrates a process flow showing an embodiment for determining the focus of sound for a time segment of spatial audio, in accordance with embodiments of the present invention.

With reference to FIG. 6, a process flow is provided showing an embodiment of method 600 for determining intensity of sound for time segment(s) of spatial audio, in accordance with embodiments of the present invention. Method 600 can be performed, for example by focus component 218 of spatial audio visualization system 204, as illustrated in FIG. 2.

At block 602, a time segment of spatial audio can be selected to determine the intensity of sound for that time segment. The selected time segment can be, for example, the same time segment selected at block 402 to determine position and/or the same time segment selected at block 502 to determine intensity.

At block 604, the position of sound can be received for the selected time segment of spatial audio. The position of sound can be received from, for example, block 414 of FIG. 4. Such a position can be received in the form of a vector: v=<x, y, z>.

At block 606, the length of the sound vector for the position of sound can be analyzed. Prior to normalizing the sound vector, it will have a length between 0 and 1. When the length is 0, there is no spatial aspect of the sound, the sound is only omnidirectional so v=<0, 0, 0>. When the length is 1, there is an extreme spatial component to the sound, in that the sound is entirely coming from one direction and there is not any audio in any other direction.

Based on the analysis at block 606, at block 608, the focus of sound at the selected time segment can be determined. An equation that can be used for determining focus is $F=\sqrt{x^2+y^2+z^2}$, where x, y, and z are the x axis, y axis, and z axis position of sound at a time segment of spatial audio. Blocks 602 through 608 can be repeated as necessary for additional time segments of spatial audio to determine the focus of sound additional time segments. At block 610, the intensity of audio can be output for the time segment(s) that focus was determined for.

Figure 7:
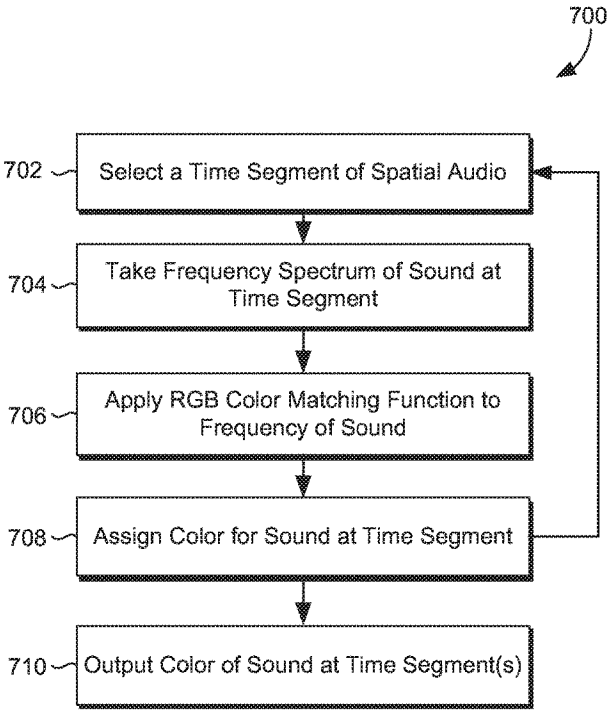
FIG. 7 illustrates a process flow showing an embodiment for determining the color associated with the frequency of sound for a time segment of spatial audio, in accordance with embodiments of the present invention.

With reference to FIG. 7, a process flow is provided showing an embodiment of method 700 for determining intensity of sound for time segment(s) of spatial audio, in accordance with embodiments of the present invention. Method 700 can be performed, for example by color component 220 of spatial audio visualization system 204, as illustrated in FIG. 2.

At block 702, a time segment of spatial audio can be selected to determine the color of sound for that time segment. The selected time segment can be, for example, the same time segment selected at block 402 to determine position and/or the same time segment selected at block 502 to determine intensity and/or the same time segment selected at block 602 to determine focus.

At block 704, the frequency spectrum for sound at the time segment can be taken. Taking the frequency spectrum can be accomplished using fast Fourier transform (FFT). FFT can be used to create bands around a frequency to designate frequency bins that are even in size, non-overlapping, and cover the whole spectrum.

At block 706, the frequency spectrum can be mapped to a RGB color using color matching functions. The defined peak response frequency for red can be set at 125 Hz, green at 500 Hz, and blue at 875 Hz. The color matching functions for each color go linearly from 0 to the peak response and then back to 0. Such a frequency range is capable of being increased or decreased based on the attributes of sound to visualize from the spatial audio. The peak response frequencies can be adjusted based on the minimum and maximum frequency to ensure that the distribution of color across the spectrums are equal. At block 708, the color of sound for the time segment can be determined based on the color matching functions. Blocks 702 through 708 can be repeated as necessary for additional time segments of spatial audio to determine the color of sound additional time segments. At block 710, the color of audio can be output for the time segment(s) that color was determined for the spatial audio.

Figure 8:
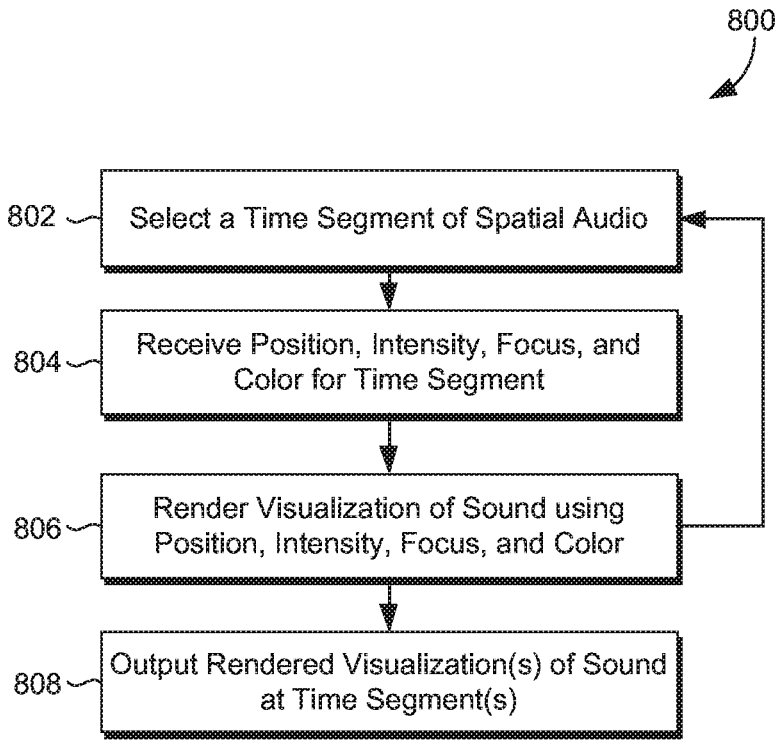
FIG. 8 illustrates a process flow showing an embodiment for rendering a visualization using determining position, intensity, focus and frequency of sound for a time segment of spatial audio, in accordance with embodiments of the present invention.

With reference to FIG. 8, a process flow is provided showing an embodiment of method 800 for rendering a visualization(s) of sound for time segment(s) of spatial audio, in accordance with embodiments of the present invention. Method 800 can be performed, for example by rendering manager 208 of spatial audio visualization system 204, as illustrated in FIG. 2.

At block 802, a time segment of spatial audio can be selected to render a visualization of sound for the spatial audio. The selected time segment can be, for example, the same time segment selected at block 402 to determine position and/or the same time segment selected at block 502 to determine intensity and/or the same time segment selected at block 602 to determine focus, and/or the same time segment selected at block 702 to determine color.

At block 804, the position, intensity, focus, and color for the selected time segment can be obtained. Properties such as position, intensity, focus, and color can be determined, for example, using visualization engine 212 of spatial audio visualization system 204, as illustrated in FIG. 2. The processes for determining position, intensity, focus, and color for a selected time segment are further described with reference to FIGS. 4-7.

At block 806, a visualization of a selected time segment for spatial audio can be rendered. In embodiments, a time segment of the spatial audio can be rendered into a visualization using a particle or blob. Such a particle(s) can be generated by mapping determined properties for the time segment using, for instance, the properties received at block 804. In the visualization rendering process, position can be utilized to display a particle at the position where sound is originating, determined intensity can be used to indicate how much energy the particle has using opacity, determined focus can be used to indicate how concentrated sound by utilizing the size of the particle, and color can be used to indicate the frequency of the particle by displaying a RGB color(s) based on the frequency at the time segment. In another embodiment, color can be displayed using up to three particles for each time segment where one particle indicates "blue," one "green," and another "red." In such an embodiment, a single rendered frame can result in the visualization of up to 30 distinct particles.

Figure 9A:
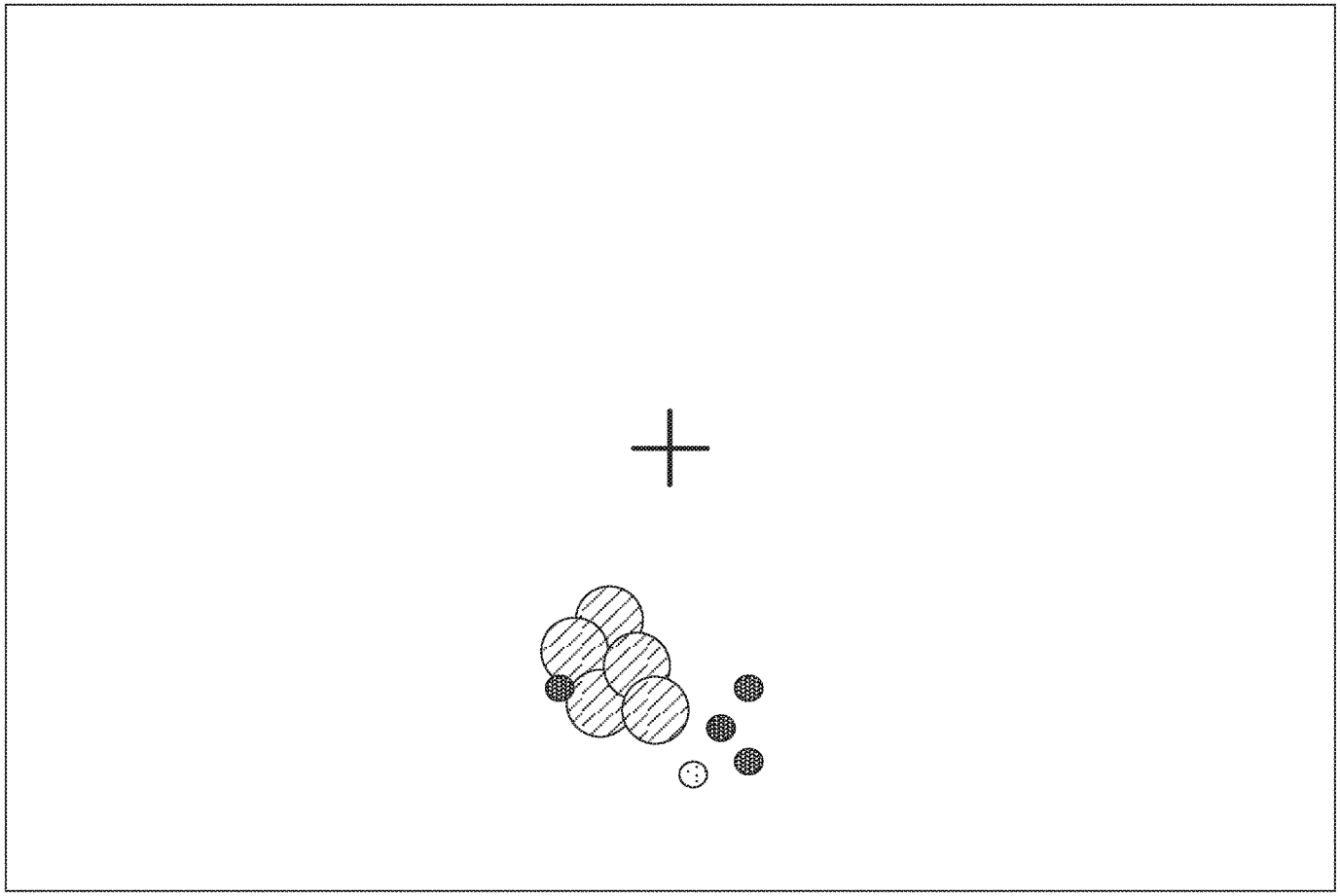
FIG. 9A depicts an illustrative frame of visualization of spatial audio, in accordance with embodiments of the present disclosure.
Figure 9B:
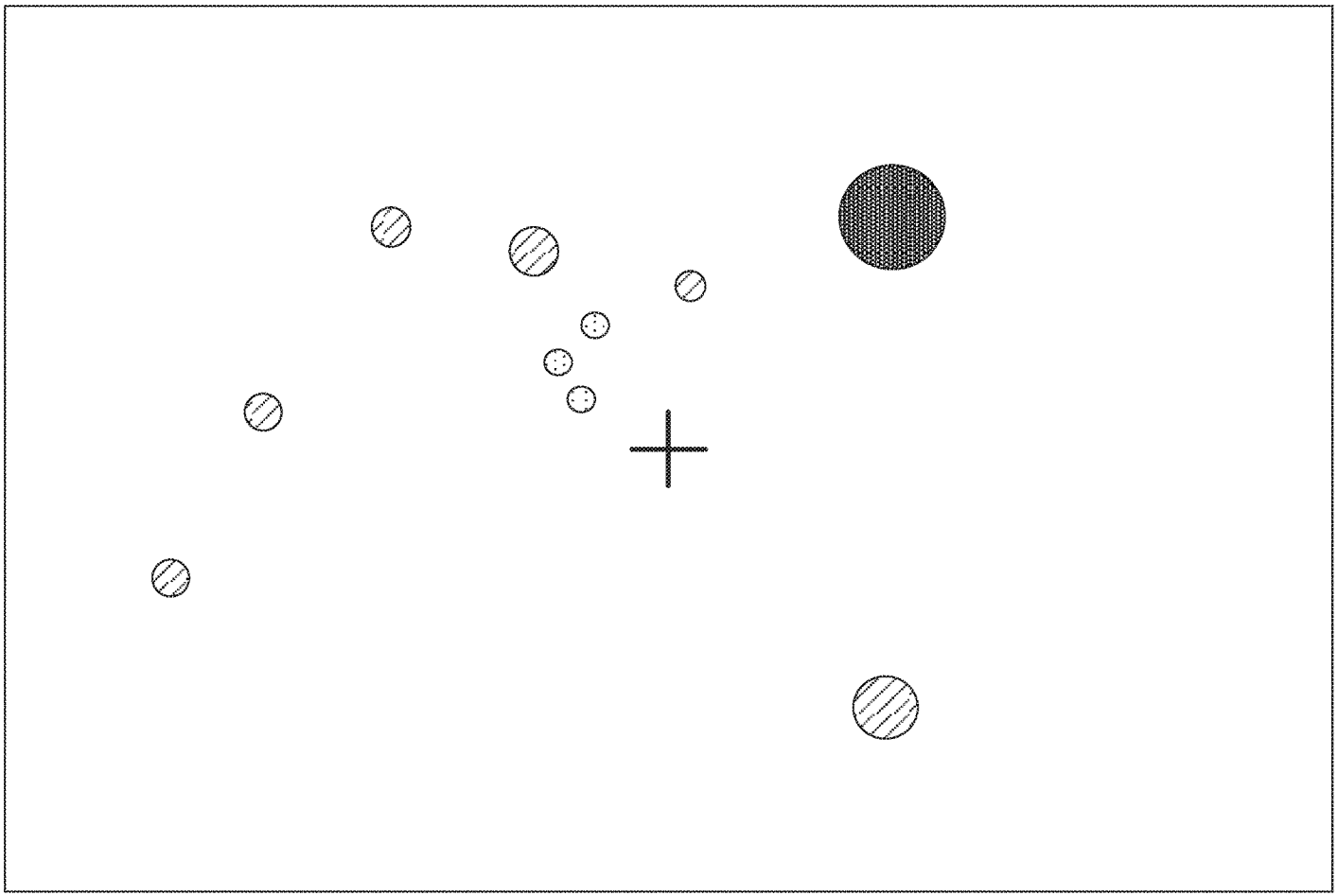
FIG. 9B depicts an illustrative frame of visualization of spatial audio, in accordance with embodiments of the present disclosure.
Figure 9C:
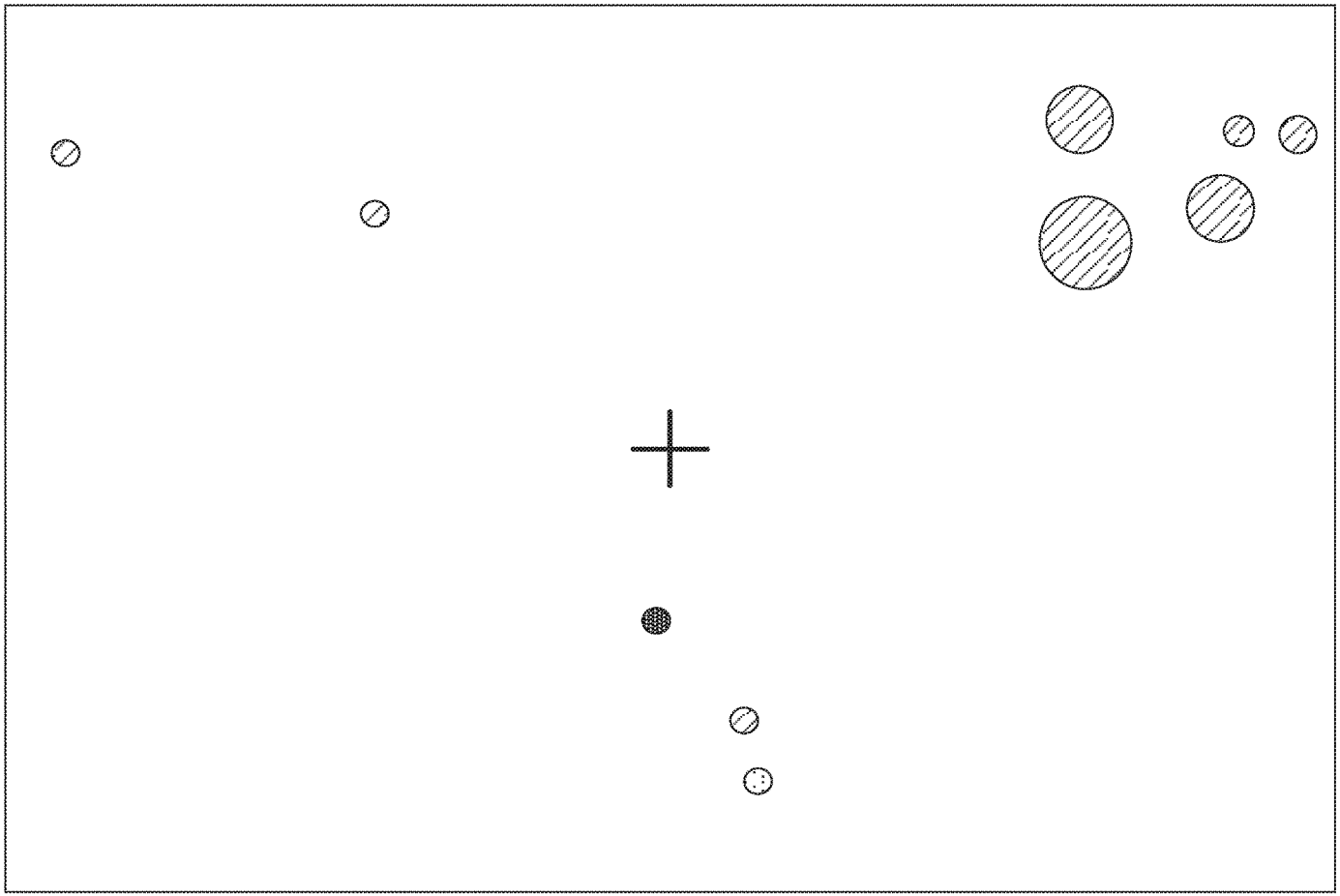
FIG. 9C depicts an illustrative frame of visualization of spatial audio, in accordance with embodiments of the present disclosure.

FIGS. 9A-9C depict illustrative visualization(s) of spatial audio, in accordance with embodiments of the present disclosure. FIG. 9A depicts a rendered visualization(s) of one frame of video that includes ten particles. Each of these ten particles indicates sound for a 10 ms segment of spatial audio. Because a frame of video is typically 30 frames per second, for each frame of visualization, ten pixels, each representing 10 ms can be displayed. FIG. 9B depicts a rendered visualization(s) of another frame of video. Properties for the sound at a 10 ms time segment of spatial audio can be displayed using various attributes of a particle. Placement of a particle can indicate the position of the sound within the environment the spatial audio was generated within. Intensity can be displayed using size of a particle. The larger in size a particle appears, the more noise or energy is occurring at the time segment of spatial audio. Focus can be displayed using opacity of a particle. The more opaque a particle appears, the less focused the sound is at the time segment of spatial audio. Color can indicate the frequency of sound at the time segment of spatial audio. Such color can take into account multiple frequencies that are captured at the same time segment, when a sound has frequencies that can be depicted using red and yellow, the particle can appear as a mix of the colors, or orangeish. FIG. 9C depicts a rendered visualization(s) of a third frame of video.

Figure 10:
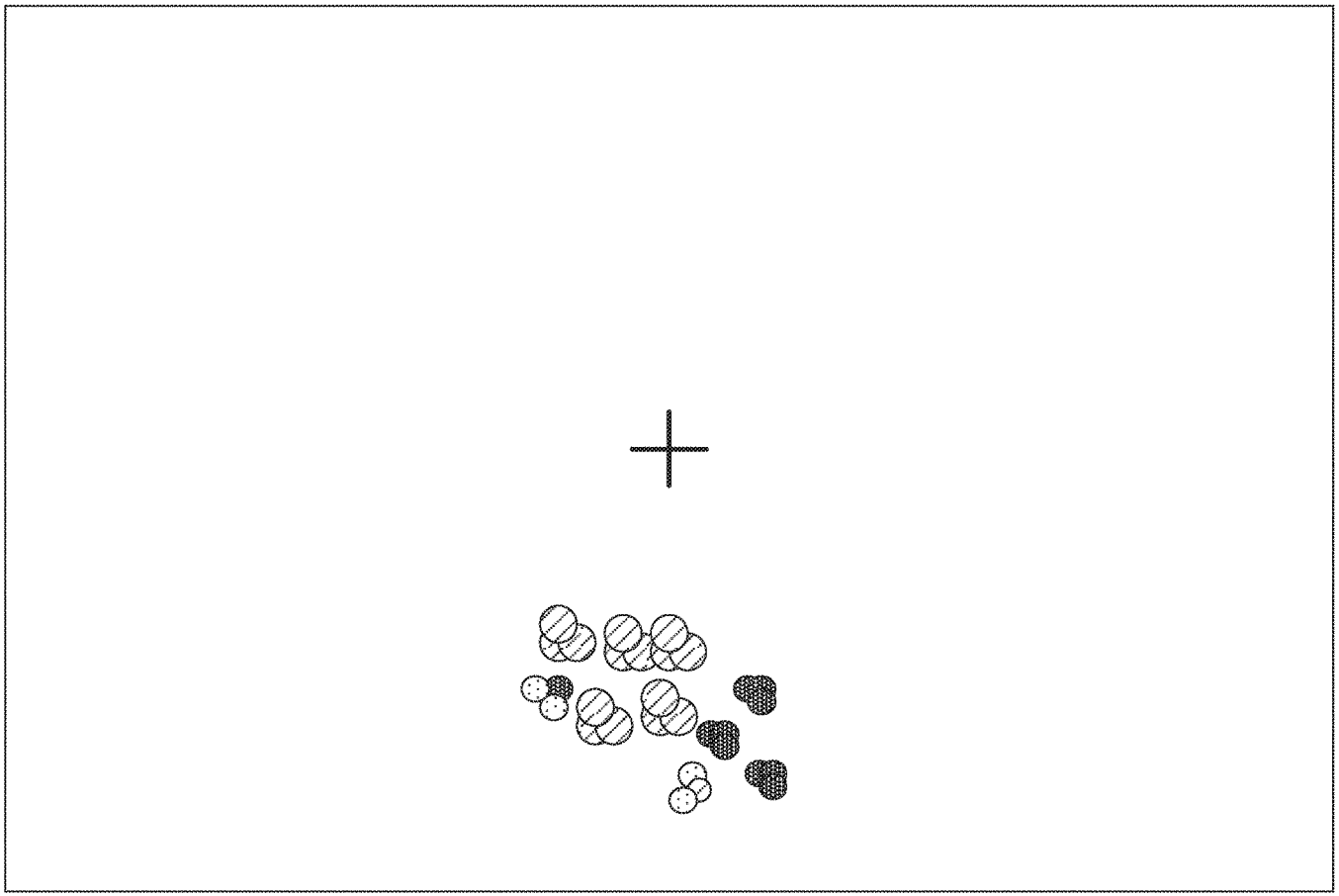
FIG. 10 depicts an illustrative frame of visualization of spatial audio where multiple particles are used for displaying color associated with frequency of sound at a time segment of the spatial audio, in accordance with embodiments of the present disclosure.

FIG. 10 depicts illustrative visualization(s) of spatial audio, in accordance with embodiments of the present disclosure. FIG. 10 depicts a rendered visualization(s) of one frame of video including 30 particles. Each of these 30 particles indicates sound for a 10 ms segment of spatial audio. Because a frame of video is typically 30 frames per second, for each frame of visualization, 30 pixels, each representing 10 ms can be displayed along with one particle for each possible color. Properties for the sound at a 10 ms time segments of spatial audio can be displayed using various attributes of the particle.

Figure 11:
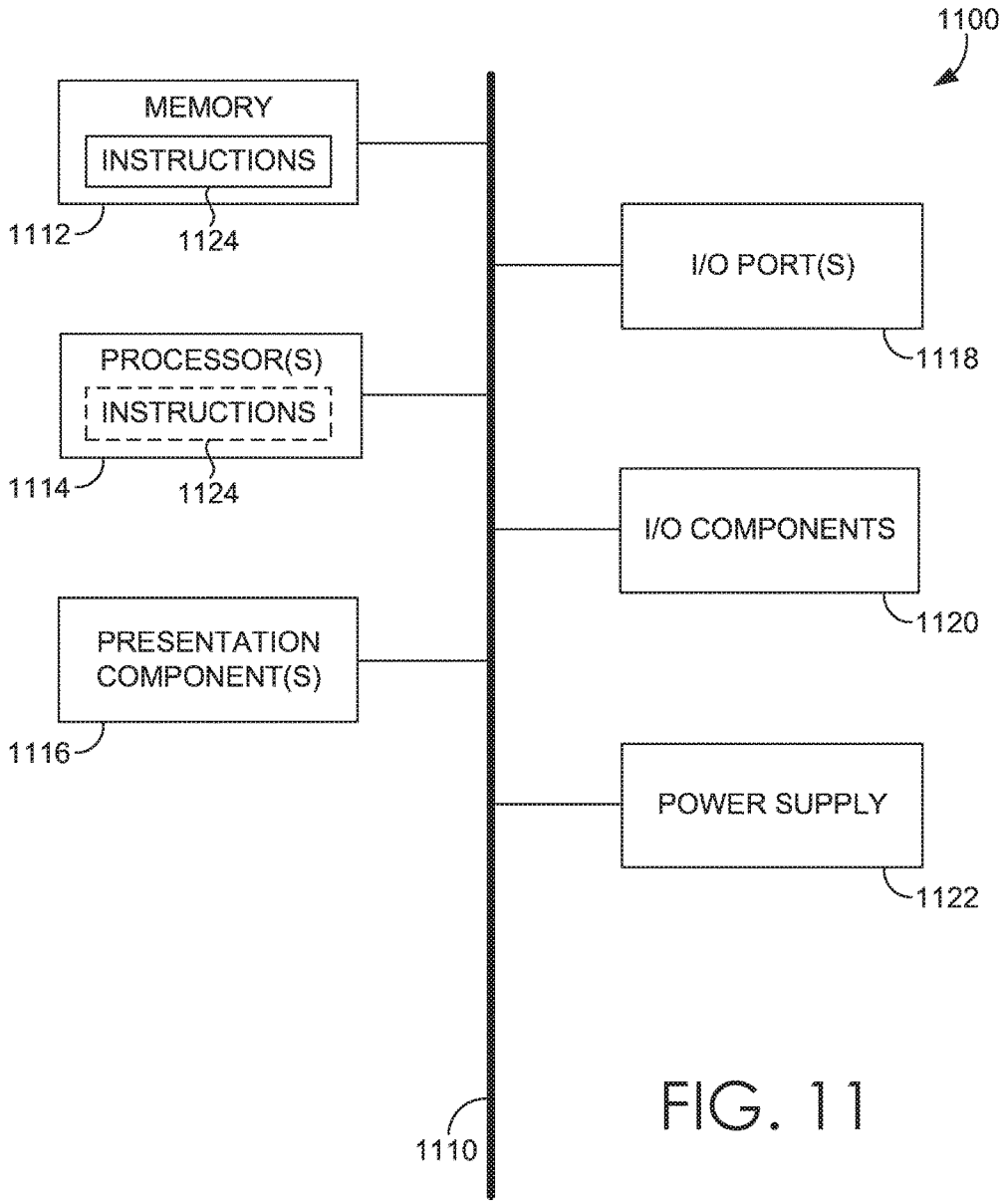
FIG. 11 is a block diagram of an example computing device in which embodiments of the present disclosure may be employed.

Having described embodiments of the present invention, FIG. 11 provides an example of a computing device in which embodiments of the present invention may be employed. Computing device 1100 includes bus 1110 that directly or indirectly couples the following devices: memory 1112, one or more processors 1114, one or more presentation components 1116, input/output (I/O) ports 1118, input/output components 1120, and illustrative power supply 1122. Bus 1110 represents what may be one or more busses (such as an address bus, data bus, or combination thereof). Although the various blocks of FIG. 11 are shown with lines for the sake of clarity, in reality, delineating various components is not so clear, and metaphorically, the lines would more accurately be gray and fuzzy. For example, one may consider a presentation component such as a display device to be an I/O component. Also, processors have memory. The inventors recognize that such is the nature of the art and reiterate that the diagram of FIG. 11 is merely illustrative of an exemplary computing device that can be used in connection with one or more embodiments of the present invention. Distinction is not made between such categories as "workstation," "server," "laptop," "handheld device," etc., as all are contemplated within the scope of FIG. 11 and reference to "computing device."

Computing device 1100 typically includes a variety of computer-readable media. Computer-readable media can be any available media that can be accessed by computing device 1100 and includes both volatile and nonvolatile media, removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules, or other data. Computer storage media includes, but is not limited to, RAM, ROM, EEPROM, flash memory or other memory technology, CD-ROM, digital versatile disks (DVDs) or other optical disk storage, magnetic cassettes, magnetic tape, magnetic disk storage or other magnetic storage devices, or any other medium which can be used to store the desired information and which can be accessed by computing device 1100. Computer storage media does not comprise signals per se. Communication media typically embodies computer-readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media, such as a wired network or direct-wired connection, and wireless media, such as acoustic, RF, infrared, and other wireless media. Combinations of any of the above should also be included within the scope of computer-readable media.

Memory 1112 includes computer storage media in the form of volatile and/or nonvolatile memory. As depicted, memory 1112 includes instructions 1124. Instructions 1124, when executed by processor(s) 1114 are configured to cause the computing device to perform any of the operations described herein, in reference to the above discussed figures, or to implement any program modules described herein. The memory may be removable, non-removable, or a combination thereof. Exemplary hardware devices include solid-state memory, hard drives, optical-disc drives, etc. Computing device 1100 includes one or more processors that read data from various entities such as memory 1112 or I/O components 1120. Presentation component(s) 1116 present data indications to a user or other device. Exemplary presentation components include a display device, speaker, printing component, vibrating component, etc.

I/O ports 1118 allow computing device 1100 to be logically coupled to other devices including I/O components 1120, some of which may be built in. Illustrative components include a microphone, joystick, game pad, satellite dish, scanner, printer, wireless device, etc. I/O components 1120 may provide a natural user interface (NUI) that processes air gestures, voice, or other physiological inputs generated by a user. In some instances, inputs may be transmitted to an appropriate network element for further processing. An NUI may implement any combination of speech recognition, touch and stylus recognition, facial recognition, biometric recognition, gesture recognition both on screen and adjacent to the screen, air gestures, head and eye tracking, and touch recognition associated with displays on computing device 1100. Computing device 1100 may be equipped with depth cameras, such as stereoscopic camera systems, infrared camera systems, RGB camera systems, and combinations of these, for gesture detection and recognition. Additionally, computing device 1100 may be equipped with accelerometers or gyroscopes that enable detection of motion. The output of the accelerometers or gyroscopes may be provided to the display of computing device 1100 to render immersive augmented reality or virtual reality.

Embodiments presented herein have been described in relation to particular embodiments which are intended in all respects to be illustrative rather than restrictive. Alternative embodiments will become apparent to those of ordinary skill in the art to which the present disclosure pertains without departing from its scope.

Various aspects of the illustrative embodiments have been described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features have been omitted or simplified in order not to obscure the illustrative embodiments.

Various operations have been described as multiple discrete operations, in turn, in a manner that is most helpful in understanding the illustrative embodiments; however, the order of description should not be construed as to imply that these operations are necessarily order dependent. In particular, these operations need not be performed in the order of presentation. Further, descriptions of operations as separate operations should not be construed as requiring that the operations be necessarily performed independently and/or by separate entities. Descriptions of entities and/or modules as separate modules should likewise not be construed as requiring that the modules be separate and/or perform separate operations. In various embodiments, illustrated and/or described operations, entities, data, and/or modules may be merged, broken into further sub-parts, and/or omitted.

The phrase "in one embodiment" or "in an embodiment" is used repeatedly. The phrase generally does not refer to the same embodiment; however, it may. The terms "comprising," "having," and "including" are synonymous, unless the context dictates otherwise. The phrase "A/B" means "A or B." The phrase "A and/or B" means "(A), (B), or (A and B)." The phrase "at least one of A, B and C" means "(A), (B), (C), (A and B), (A and C), (B and C) or (A, B and C)."

What is claimed is:

1. A computer-implemented method, the method comprising:

accessing spatial audio having a plurality of time segments;

determining a set of properties corresponding with a time segment of the spatial audio, wherein the set of properties include a position, a focus, and a frequency associated with the time segment of the spatial audio; and generating a visualization for the time segment of the spatial audio using a particle having attributes that visually represent the set of properties, wherein a first attribute of the particle represents the position associated with the time segment of the spatial audio, a second attribute of the particle represents the focus associated with the time segment of the spatial audio, and a third attribute of the particle represents the frequency associated with the time segment of the spatial audio.

2. The computer-implemented method of claim 1, wherein the set of properties further includes an intensity associated with the time segment of the spatial audio.

3. The computer-implemented method of claim 2, wherein a fourth attribute of the particle represents the intensity associated with the time segment of the spatial audio, wherein the fourth attribute of the particle representing the intensity of the time segment of the spatial audio is displayed using opacity of the particle.

4. The computer-implemented method of claim 1, wherein the second attribute of the particle representing the focus associated with the time segment of the spatial audio is displayed using size of the particle.

5. The computer-implemented method of claim 1, wherein the third attribute of the particle representing the frequency associated with the time segment of the spatial audio is displayed using color of the particle.

6. The computer-implemented method of claim 1, wherein determining the position associated with the time segment of the spatial audio includes incorporating an omnidirectional audio component into a left/right audio component, an up/down audio component, and a forward/backward audio component.

7. The computer-implemented method of claim 6, the omnidirectional audio component is incorporated by taking a first root mean square error of the sum of the omnidirectional audio component plus the left/right audio component, the up/down audio component, or the forward/backward audio component and subtracting a second root mean square error of the sum of the omnidirectional audio component minus the left/right audio component, the up/down audio component, or the forward/backward audio component.

8. The computer-implemented method of claim 2, wherein determining the intensity associated with the time segment of the spatial audio includes analyzing an omnidirectional audio component to determine how much energy is occurring during the time segment.

9. The computer-implemented method of claim 1, wherein determining the focus associated with the time segment of the spatial audio includes analyzing the position of the spatial audio to determine how concentrated the spatial audio is during the time segment.

10. The computer-implemented method of claim 5, wherein determining the color associated with the particle is based on an analysis of frequency of the time segment of the spatial audio.

11. The computer-implemented method of claim 5, wherein the color of the particle is displayed using a first particle for red, a second particle for green, and a third particle for blue.

12. One or more non-transitory computer-readable media having a plurality of executable instructions embodied thereon, which, when executed by one or more processors, cause the one or more processors to perform operations comprising:

receiving a request to visualize spatial audio;

determining a position associated with a time segment of the spatial audio;

generating a position vector based on the determined position associated with the time segment of the spatial audio;

determining a focus associated with the time segment of the spatial audio using the position vector; and utilizing the position vector for visualization of the time segment of the spatial audio, wherein the visualization uses a particle placed at a location based at the determined position associated with the time segment of the spatial audio, the particle having an attribute that visually represents the focus.

13. The non-transitory computer-readable media of claim 12, wherein the determining the focus associated with the time segment of the spatial audio uses a length of the position vector.

14. The non-transitory computer-readable media of claim 12, further comprising:

taking a frequency spectrum of the time segment of the spatial audio;

applying color matching based on the frequency spectrum of the time segment of the spatial audio; and determining color associated with the time segment of the spatial audio.

15. The non-transitory computer-readable media of claim 12, further comprising:

determining an intensity associated with the time segment of the spatial audio.

16. The non-transitory computer-readable media of claim 12, further comprising:

rendering a visualization of the time segment of the spatial audio utilizing the position vector of the time segment of the spatial audio.

17. A computing system comprising:

means for determining one or more properties of spatial audio, wherein the properties include a position, an intensity, a focus, and a frequency; and means for visualizing the spatial audio using a particle with attributes based on the one or more properties of the spatial audio, wherein a first attribute of the particle represents the position associated with the spatial audio, a second attribute of the particle represents the focus associated with the spatial audio, a third attribute of the particle represents the frequency associated with the spatial audio, and a fourth attribute of the particle represents the intensity of the time segment associated with the spatial audio.

18. The system of claim 17, wherein determining the position associated with the spatial audio includes incorporating an omnidirectional audio component into a left/right audio component, an up/down audio component, and a forward/backward audio component.

19. The system of claim 17, wherein the spatial audio is visualized using the particle placed at coordinates based on the position associated with the spatial audio.

20. The system of claim 19, wherein the spatial audio is further visualized using the particle with opacity based on the intensity associated with the spatial audio, with a size based on the focus associated with the spatial audio, and a color based on the frequency associated with the spatial audio.

* * * * *